US009645526B2

(12) United States Patent
Oba et al.

(10) Patent No.: US 9,645,526 B2
(45) Date of Patent: May 9, 2017

(54) POWDER CONTAINING DEVICE AND IMAGE FORMING APPARATUS

(71) Applicant: FUJI XEROX CO., LTD., Tokyo (JP)

(72) Inventors: Shota Oba, Kanagawa (JP); Norihiro Tamazawa, Kanagawa (JP); Ayumi Noguchi, Kanagawa (JP); Makoto Kanno, Kanagawa (JP); Keisuke Kubo, Kanagawa (JP); Seigo Shinozaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/989,208

(22) Filed: Jan. 6, 2016

(65) Prior Publication Data

US 2017/0052479 A1 Feb. 23, 2017

(30) Foreign Application Priority Data

Aug. 17, 2015 (JP) ..... 2015-160302

(51) Int. Cl.
*G03G 15/08* (2006.01)

(52) U.S. Cl.
CPC ..... *G03G 15/0877* (2013.01)

(58) Field of Classification Search
CPC ..... G03G 15/0877; G03G 15/0872; G03G 2215/0668; G03G 2215/0678
See application file for complete search history.

(56) References Cited

U.S. PATENT DOCUMENTS

2004/0126144 A1* 7/2004 Yoshino ..... G03G 15/0872 399/262
2004/0223790 A1 11/2004 Hosokawa et al.
2007/0122205 A1* 5/2007 Taguchi ..... G03G 15/0855 399/258
2007/0177905 A1 8/2007 Hosokawa et al.
2007/0269236 A1* 11/2007 Takuwa ..... G03G 15/0872 399/258
2008/0003021 A1 1/2008 Hosokawa et al.
2008/0286013 A1 11/2008 Hosokawa et al.
2009/0175660 A1 7/2009 Hosokawa et al.
2011/0026973 A1 2/2011 Hosokawa et al.
2011/0249991 A1 10/2011 Hosokawa et al.
2015/0338775 A1* 11/2015 Hosokawa ..... G03G 15/0868 399/258

FOREIGN PATENT DOCUMENTS

JP 2004280064 A 10/2004
JP 2010210946 A 9/2010

* cited by examiner

*Primary Examiner* — Sandra Brase
(74) *Attorney, Agent, or Firm* — Oliff PLC

(57) ABSTRACT

Provided is a powder containing device including a powder container that contains powder, that has a first end which is closed, that has a second end which is opened, that includes a main body section and a tapered section which is disposed on the second end side from the main body section and has a diameter reduced as close to the second end side, and that has an inner circumferential surface on which a protruding ridge is formed to convey the powder to the second end side by rotating around a rotation axis extending in a direction in which the first end and the second end is connected, and a lid member that is provided with an outlet of the powder, is maintained in a non-rotating state, and causes the powder flowing from the opening to flow out from the outlet.

16 Claims, 8 Drawing Sheets

POWDER CONTAINING DEVICE AND IMAGE FORMING APPARATUS

CROSS-REFERENCE TO RELATED APPLICATIONS

This application is based on and claims priority under 35 USC 119 from Japanese Patent Application No. 2015-160302 filed Aug. 17, 2015.

BACKGROUND

Technical Field

The present invention relates to a powder containing device and an image forming apparatus.

SUMMARY

According to an aspect of the invention, there is provided a powder containing device including:

a powder container that contains powder, that has a first end which is closed, that has a second end which is opened, that includes a main body section and a tapered section which is disposed on the second end side from the main body section and has a diameter reduced as close to the second end side, and that has an inner circumferential surface on which a protruding ridge is formed to convey the powder to the second end side by rotating around a rotation axis extending in a direction in which the first end and the second end is connected; and a lid member that is provided with an outlet of the powder, is maintained in a non-rotating state, and causes the powder flowing from the opening to flow out from the outlet, wherein the protruding ridge is formed from the main body section to reaching the tapered section, at narrower intervals in the tapered section than in the main body section.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
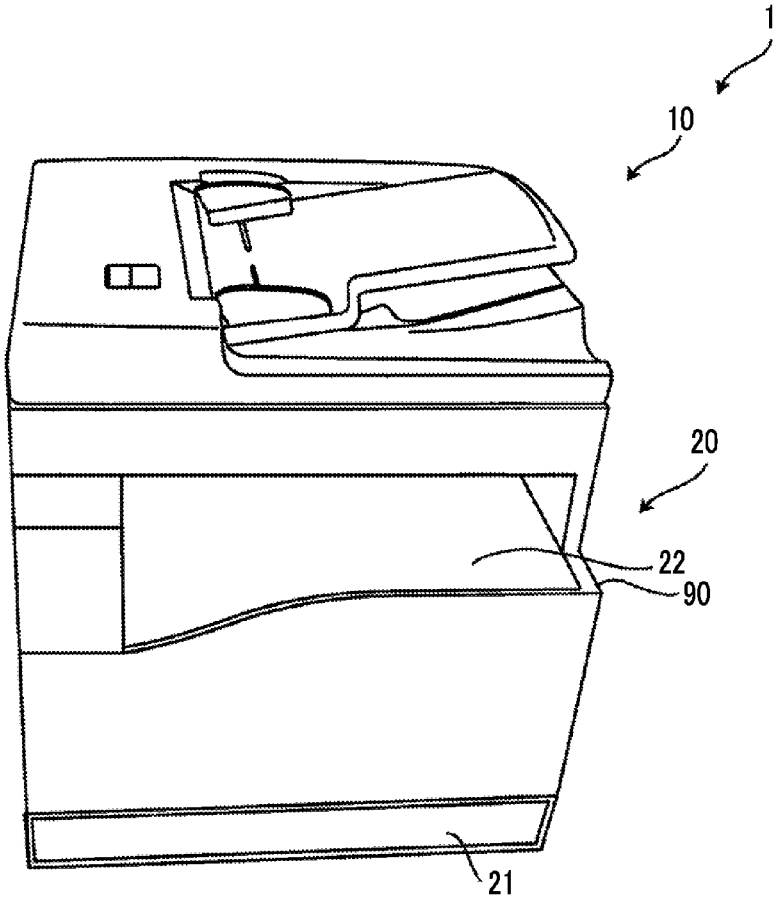
FIG. 1 is a perspective view illustrating the external appearance of an image forming apparatus as an exemplary embodiment of the invention.

FIG. 1 is a perspective view illustrating the external appearance of an image forming apparatus as an exemplary embodiment of the invention.

An image forming apparatus 1 includes a scanner 10 and a printer 20.

The scanner 10 is mounted on an apparatus housing 90 as a framework of the image forming apparatus 1 and the printer 20 is configured in the apparatus housing 90.

Figure 2:
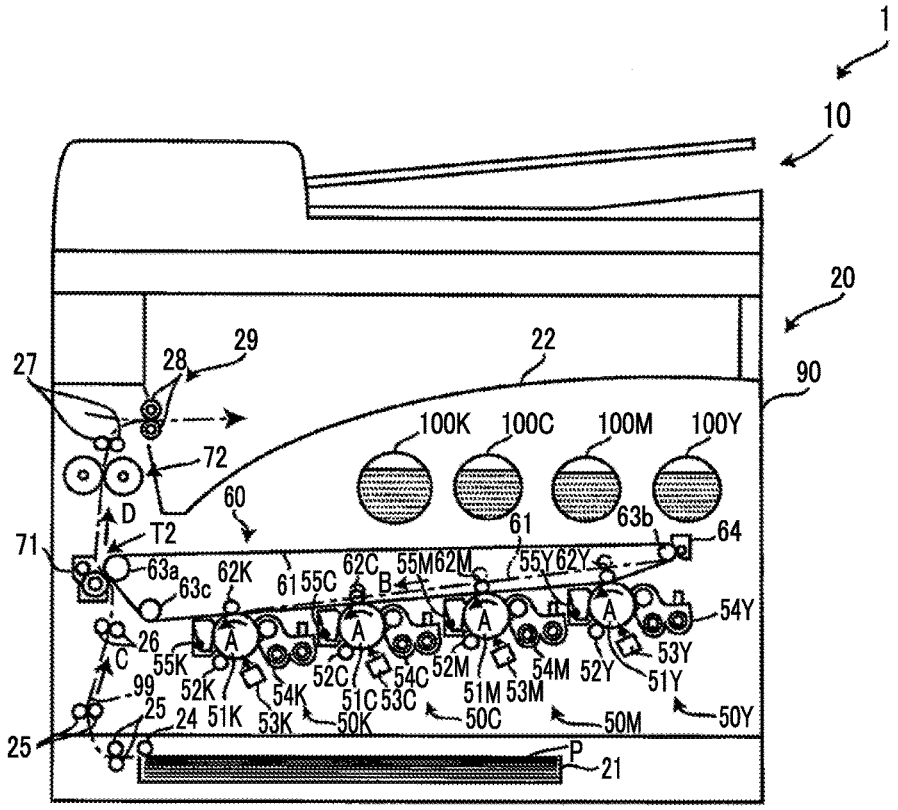
FIG. 2 is a view schematically illustrating an internal configuration of an image forming apparatus of which the external appearance is illustrated in FIG. 1.

FIG. 2 is a view schematically illustrating an internal configuration of the image forming apparatus of which the external appearance is illustrated in FIG. 1.

The printer 20 includes four image forming units 50Y, 50M, 50C, and 50K which are substantially transversely arranged in a row. In the image forming units 50Y, 50M, 50C, and 50K, toner images are formed using the respective toners of yellow (Y), magenta (M), cyan (C), black (K), respectively. Here, in common description of the image forming units 50Y, 50M, 50C, and 50K, signs of Y, M, C, and K which represent distinguishment between colors of the toners are omitted and then the image forming units are described as image forming units 50. The same is true of the other components in addition to the image forming units.

Photoreceptors 51 are provided in the image forming units 50, respectively. The photoreceptors 51 receives a driving force and rotates in an arrow A direction, an electrostatic latent image is formed on a surface thereof, and further a toner image is formed through developing.

On the periphery of the photoreceptor 51 provided in the image forming unit 50, a charging device 52, an exposure device 53, a developing device 54, a primary transferring device 62, and a cleaner 55 are provided. Here, the primary transferring device 62 is disposed at a position between the photoreceptors 51, with an intermediate transfer belt 61, to be described below, interposed. The primary transferring device 62 is a component which is not provided in the image forming unit 50, but in an intermediate transfer unit 60, to be described below.

The charging device 52 uniformly charges a surface of the photoreceptor 51.

The exposure device 53 causes the uniformly charged photoreceptor 51 to be irradiated with exposure light modulated in response to an image signal and the electrostatic latent image is formed on the photoreceptor 51.

The developing device 54 develops the electrostatic latent image formed on the photoreceptor 51 into colors of toners according to the image forming units 50Y, 50M, 50C, and 50K and a toner image is formed on the photoreceptor 51.

The primary transferring device 62 transfers the toner image formed on the photoreceptor 51 to the intermediate transfer belt 61 to be described below.

The cleaner 55 removes toner or the like remaining on the photoreceptor 51 after the transferring, from the photoreceptor 51.

The intermediate transfer unit 60 is disposed above the four image forming units 50. Also, the intermediate transferring belt 61 provided in the intermediate transfer unit 60. The intermediate transfer belt 61 is supported on plural rolls such as a driving roll 63*a*, a driven roll 63*b* and a stretching roll 63*c*. Also, the intermediate transfer belt 61 is driven by the driving roll 63*a*, and circulates and moves in an arrow B direction on the circulation route including a route along the four photoreceptors 51 which are provided on the four image forming units 50.

The toner images on the photoreceptors 51 are transferred onto the intermediate transfer belt 61 due to an operation of the primary transferring device 62 such that the images are in order superimposed. Also, the toner image transferred to the intermediate transfer belt 61 is transported to a secondary transfer position T2 by the intermediate transfer belt 61. A secondary transfer device 71 is provided at the secondary transfer position T2, the toner image on the intermediate transfer belt 61 is transferred onto a sheet of paper P transported to the secondary transfer position T2 due to an operation of the secondary transfer device 71. Transport of the paper P will be described later. After transferring of the toner image to the paper P, toner remaining on the intermediate transfer belt 61, or the like is removed from the intermediate transfer belt 61 by a cleaner 64.

A toner cartridge 100, in which the respective colors of toners are contained, is provided above the intermediate transfer unit 60. When the toner in the developing device 54 is consumed through developing, toner is supplied to the developing device 54 through a toner supply path (not illustrated) from the toner cartridge 100 in which corresponding colors of toners are contained. The toner cartridge 100 is configured to be attachable to and detachable from the apparatus housing 90, is removed when the cartridge is empty, and a new toner cartridge 100 is mounted.

One sheep of paper P is picked up by a pick-up roll 24 from a paper tray 21 and is transported to a timing regulating roll 26 by a transport roll 25 on a transport path 99 in an arrow C direction. The paper P transported to the timing regulating roll 26 is sent toward the secondary transfer position so as to reach the secondary transfer position T2 on time when the toner image on the intermediate transfer belt 61 reaches the secondary transfer position T2 by the timing regulating roll 26. The paper P sent by the timing regulating roll 26 receives the transfer of the toner image from the intermediate transfer belt 61 at the secondary transfer position T2 through an operation of the secondary transfer device 71. The paper P, on which the transfer of the toner image is received, is transported in an arrow D direction and passes through a fixing device 72. The toner image on the paper P is heated and pressurized by the fixing device 72 and is fixed on the paper P. An image formed from the fixed toner image is hereby printed on the paper P. The paper on which the toner image is fixed by the fixing device 72 is further transported by a transport roll 27 and is sent on a discharge tray 22 from a discharge port 29 by a discharge roll 28.

Next, a structure of the toner cartridge 100 will be described.

Figure 3:
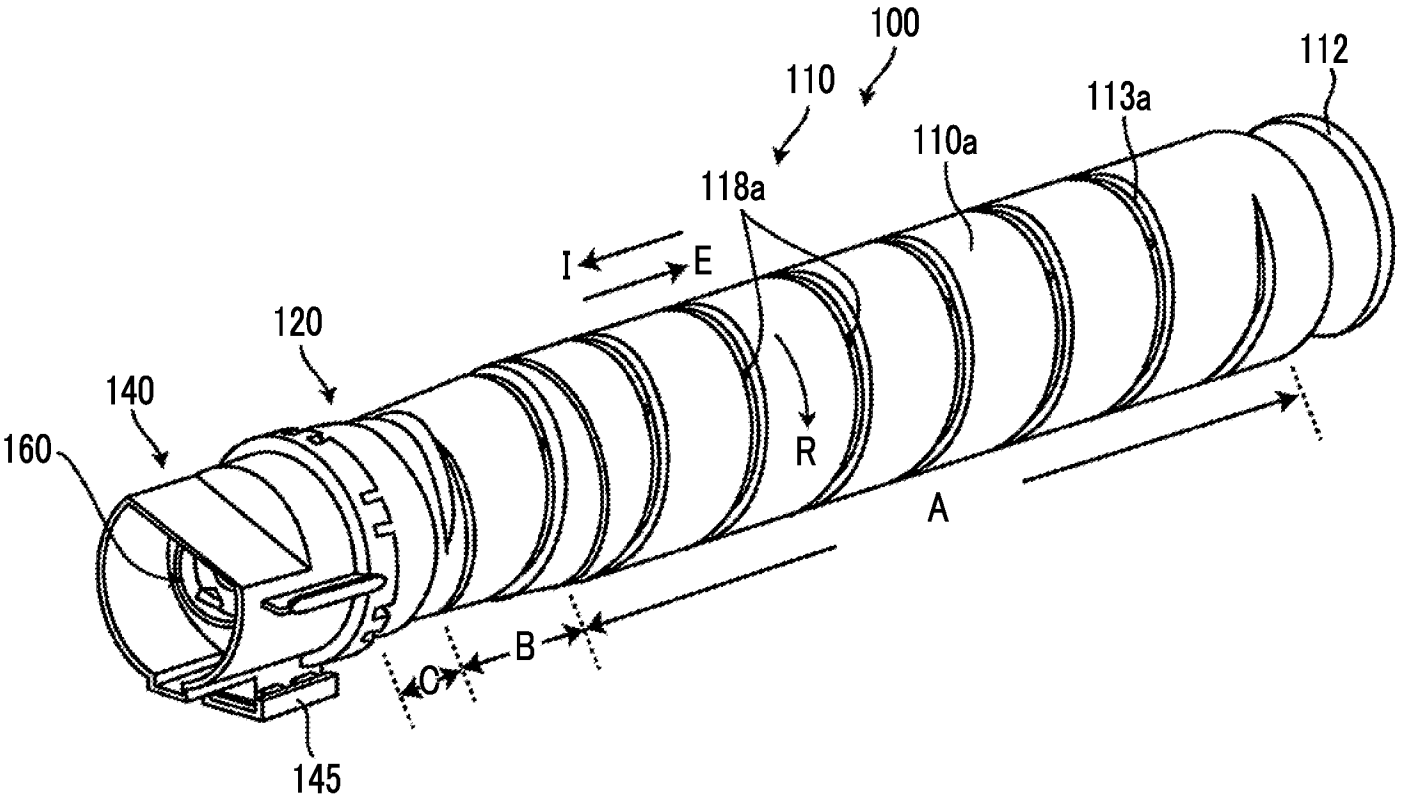
FIG. 3 is a perspective view of a toner cartridge as an exemplary embodiment, which is employed in the image forming apparatus illustrated in FIG. 1 and FIG. 2.

FIG. 3 is a perspective view of the toner cartridge as an exemplary embodiment, which is employed in the image forming apparatus illustrated in FIG. 1 and FIG. 2.

Figure 4:
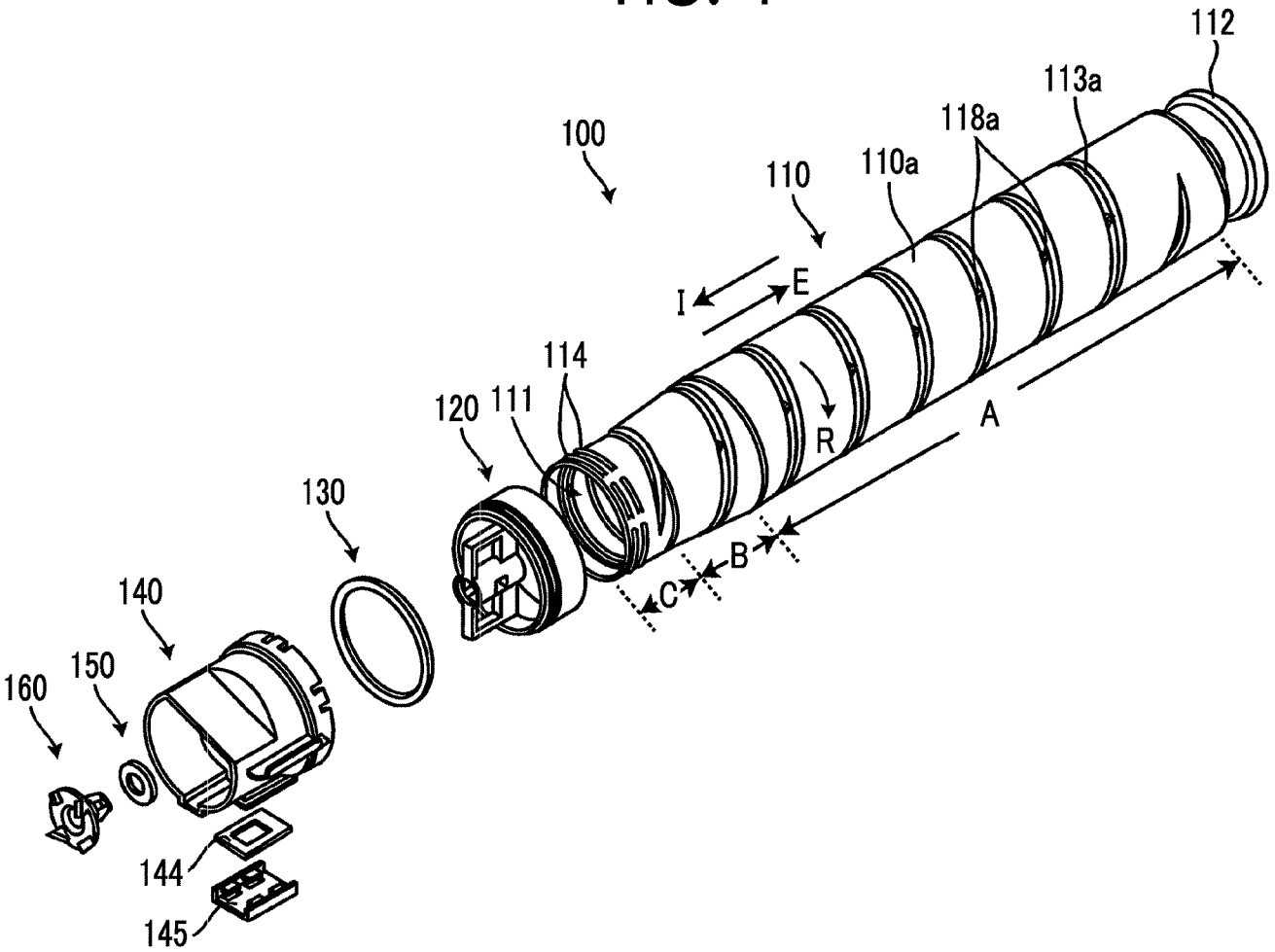
FIG. 4 is an exploded perspective view of the toner cartridge illustrated in FIG. 3.

In addition, FIG. 4 is an exploded perspective view of the toner cartridge illustrated in FIG. 3.

Figure 5:
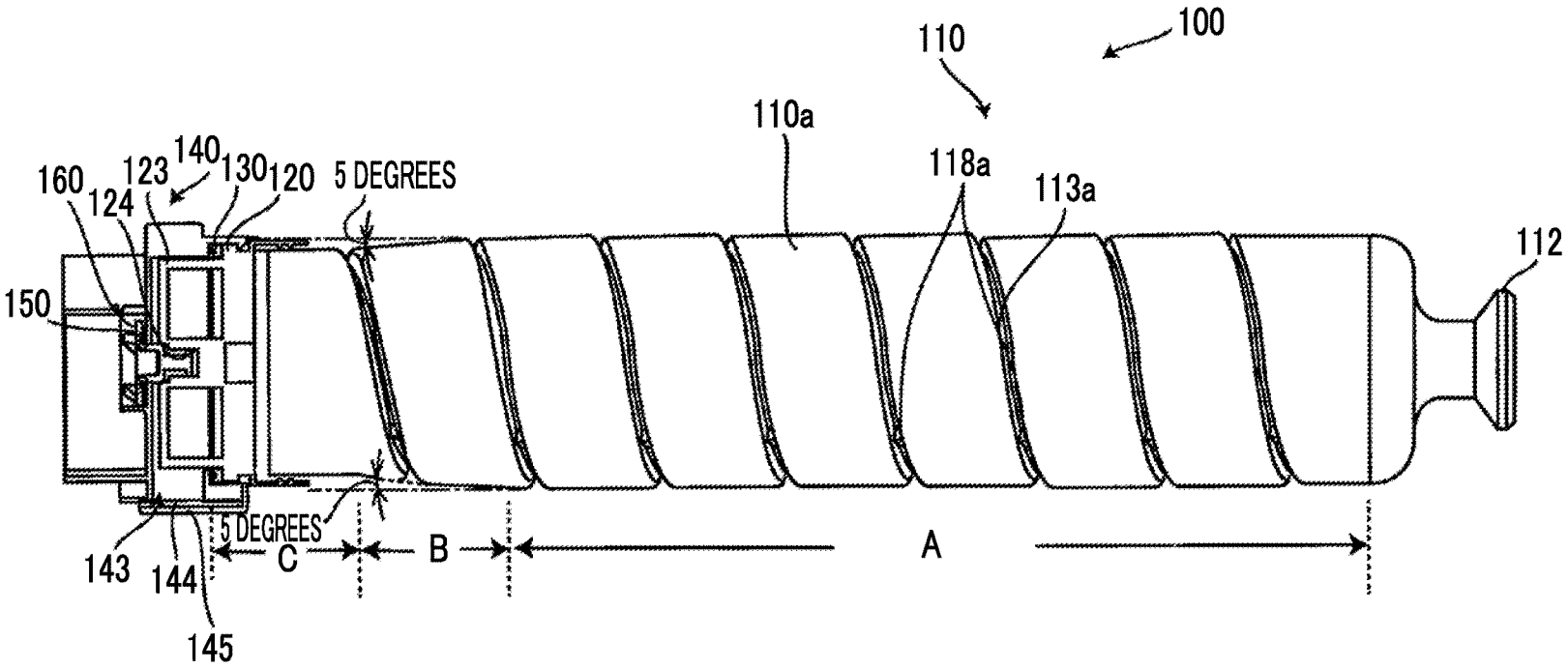
FIG. 5 is a side view of the toner cartridge illustrated in FIG. 3.

In addition, FIG. 5 is a side view of the toner cartridge illustrated in FIG. 3. Here, in FIG. 5, a sectional plane without a toner bottle is illustrated.

Figure 6:
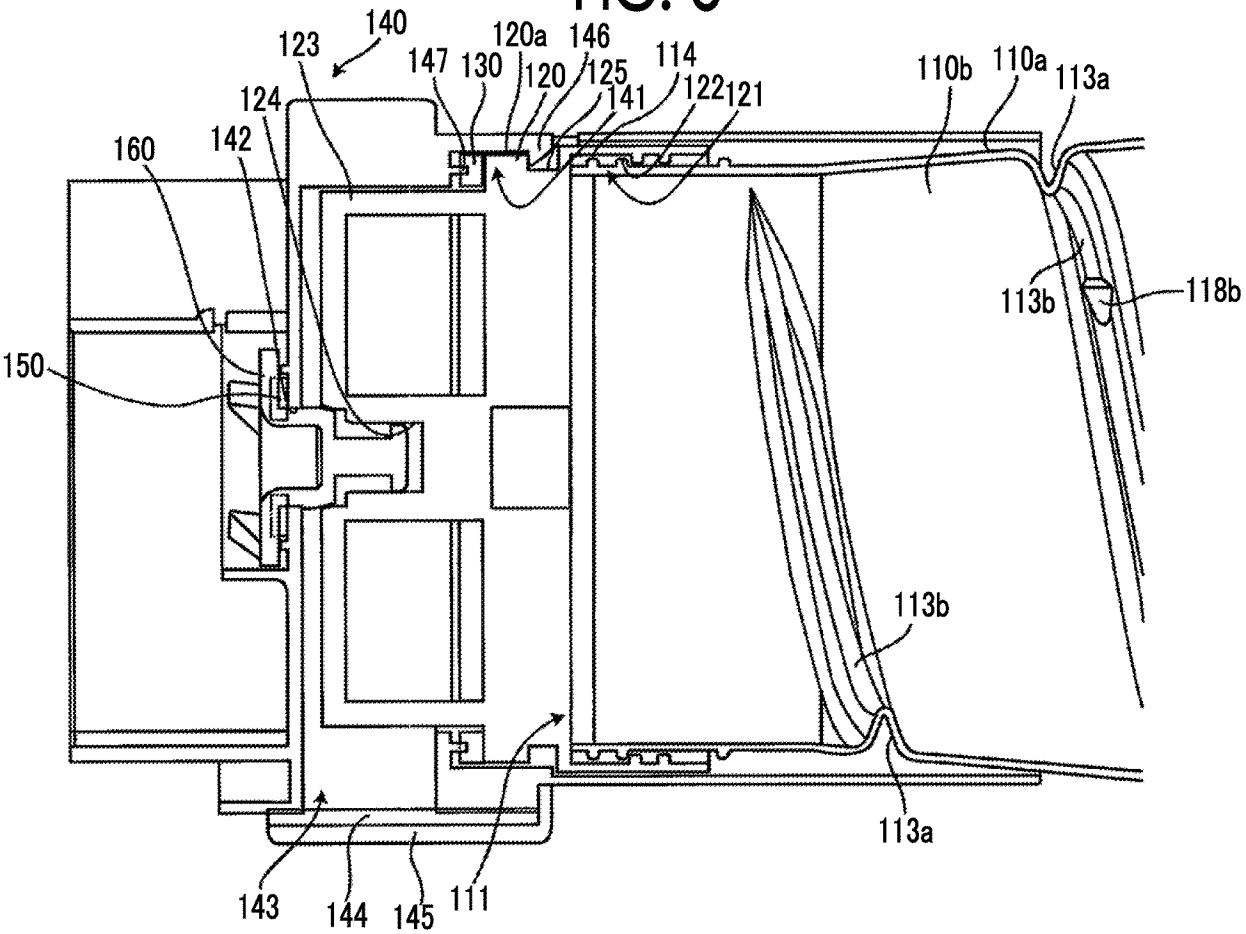
FIG. 6 is a sectional view of a portion in the vicinity of a flange of the toner cartridge illustrated in FIG. 3.

Further, FIG. 6 is a sectional view of a portion in the vicinity of a flange of the toner cartridge illustrated in FIG. 3.

As illustrated in FIG. 4, the toner cartridge 100 includes a toner bottle 110, a stirring member 120, a sealing member 130, a flange 140, another sealing member 150, and a coupling 160. The toner cartridge 100 corresponds to an example of a powder containing device in an exemplary embodiment of the invention. In addition, the toner bottle 110 corresponds to an example of a powder container. Further, an assembly of the stirring member 120 to the coupling 160 corresponds to an example of a lid member.

The toner cartridge 100 is assembled, in which the toner is contained in the toner bottle 110, in a state illustrated in FIG. 3 and the toner cartridge 100 in the assembled state is transversely disposed to be mounted in the image forming apparatus 1 illustrated in FIG. 1 and FIG. 2. In addition, the toner cartridge 100 is withdrawn in an arrow E direction when the toner bottle 110 is empty and a new cartridge 100 is mounted.

The toner bottle 110 has substantially a cylindrical shape as a whole, a first end (rear end in arrow I direction) is closed, a second end (tip end in arrow I direction) has an opening, and the toner is contained inside thereof. A handle 112, which is gripped when the toner cartridge 100 is withdrawn from the image forming apparatus 1, is provided at the first end.

In addition, the toner bottle 110 has a tapered section B formed to be close to the second end at which the opening is formed and to have a diameter as reduced as close to the opening side, to a position immediately before reaching the second end, and has an outlet section C formed on the opening side from the tapered section B to reaching the opening with a diameter uniform in a rotation axis direction (longitudinal direction).

In the present exemplary embodiment, the outlet section C is formed to have the diameter uniform in the rotation axis direction (longitudinal direction); however, the outlet section C does not need to have the uniform diameter, but may be gently inclined from the tapered section B. In addition, the toner bottle 110 has a main body section A close to (on the handle 112 side) the first end from the tapered section B. In addition, the main body section A is formed to have substantially the same diameter in the rotation axis direction in the present exemplary embodiment. Here, the main body section A does not need to have the same diameter, but, similar to the outlet section C, may be gently inclined from the tapered section B.

In addition, a groove 113*a* extending to have a spiral shape in an outer circumferential surface 110*a* of the toner bottle 110. Here, the spiral-shaped groove 113*a* is discontinuous at a reinforcement rib 118*a*. In other words, one groove 113*a* which is discontinuous and extends to have a spiral shape is formed in the outer circumferential surface 110*a* of the toner bottle 110.

The back surface of the groove 113*a* protrudes on an inner circumferential surface 110*b* of the toner bottle 110. In other words, one protruding ridge 113*b* (refer to FIG. 6) extending to have a spiral shape is formed in the inner circumferential surface 110*b* of the toner bottle 110. Here, the protruding ridge 113*b* is discontinued by a back surface 118*b* of the reinforcement rib 118*a* provided in the outer circumferential surface 110*a* and the protruding ridge extends. As will be described below, the toner bottle 110 rotates around a rotation axis extending rightward and leftward at the center of the toner bottle 110, in an arrow R direction illustrated in FIG. 3 and FIG. 4. The toner bottle 110 is filled with toner (not illustrated) and the toner is conveyed by the spiral-shaped protruding ridge 113*b* in the inner circumferential surface 110*b* to an opening 111 side when the toner bottle 110 rotates.

Here, in the present exemplary embodiment, the toner, with which the toner bottle 110 is filled, has a compression ratio of 0.35 to 0.45 and has low fluidity. As illustrated in FIG. 5, the toner bottle 110 of the present exemplary embodiment has a portion close to the opening 111, which has a radius tapered at the inclination angle of 5 degrees with respect to the rotation axis, toward the opening 111. When the inclination angle is equal to or less than 5 degrees, it is verified that the toner may be smoothly conveyed toward the opening 111 by the protruding ridge 113*b* of the inner circumferential surface 110*b* even when the compression ratio is from 0.35 to 0.45.

As above, the compression ratio is desirably from 0.35 to 0.45. This is because, when the compression ratio is less than 0.35, the fluidity is excessively high and the toner is likely to be excessively supplied, which is not good. When the compression ratio is more than 0.45, the fluidity is excessively low and there is a possibility that cogging with the toner will occur.

Hereinafter, Example of the toner having the compression ratio of 0.35 to 0.45 and Comparative Example of the toner having the compression ratio of 0.34 and 0.46 are represented.

Preparation of Resin Fine Particle Dispersion (1)

| | |
|---|---|
| Adduct of 2 mol of ethylene oxide to bisphenol A | 25 parts |
| Adduct of 2 mol of propylene oxide to bisphenol A | 25 parts |
| Terephthalic acid | 30 parts |
| Succinic acid | 5 parts |
| Trimellitic anhydride | 15 parts |

The above substances are put in a round-bottomed flask including a stirring device, a nitrogen guiding tube, a temperature sensor, and a rectifying column and are heated to 200° C. using a mantle heater. Subsequently, nitrogen gas is guided through the gas guiding tube and an inert gas atmosphere is maintained and is stirred in the flask. Then, 0.05 parts of dibutyltin oxide is added with respect to 100 parts of a row material mixture, a temperature of a reactant is maintained to be 200° C., reaction is performed for four hours, and then a resin (1) is obtained.

Subsequently, the obtained resin (1) is in a molten state and is transferred at a speed of 100 g per minute to an emulsifying machine (Cavitron CD1010, manufactured by Eurotech Ltd). Diluted ammonia water having concentration of 0.40%, which is obtained by diluting reagent ammonia water with ion-exchanged water, is put in an aqueous medium tank which is separately prepared. The diluted ammonia water is heated to 120° C. in a heat exchanger and is transferred to the emulsifying machine at a speed of 0.1 liter per minute along with the polyester resin melt. In this state, the emulsifying machine is operated under a condition in which a rotation speed of a rotor is 60 Hz and pressure is 0.49 MPa (5 kg/cm$^2$) and a resin fine particle dispersion (1) is obtained.

Preparation of Releasing Agent Dispersion

—Releasing Agent Dispersion (1)—

| | |
|---|---|
| Polyethylene wax (manufactured by Toyo Petrolite co., Ltd. Polywax 725, melting temperature: 102° C.) | 50 parts |
| Anionic surfactant (DKS Co. Ltd., Neogen RK) | 5 parts |
| Ion-exchanged water | 200 parts |

After the respective components above are mixed, is heated to 110° C. and melted, and is dispersed using a homogenizer (manufactured by IKA Works, Inc., Ultra-Turrax T50), a dispersion process is performed by using a Manton Gaulin high-pressure homogenizer (Gaulin) and a releasing agent dispersion (1) (concentration of releasing agent: 20%), in which a releasing agent having a volume average particle diameter of 220 nm is dispersed, is prepared.

Preparation of Colorant Dispersion (1)

| | |
|---|---|
| Cyan pigment (manufactured by Dainichi Seika Co., Ltd., Pigment Blue 15:3 (copper phthalocyanine)) | 1,000 parts |
| Anionic surfactant (DKS Co. Ltd., Neogen R) | 150 parts |
| Ion-exchanged water | 9,000 parts |

The above substances are mixed, are resolved, and are dispersed for about one hour using Ulimizer (Sugino Machine Limited, HJP30006) as a high pressure impact type dispersing machine, in which a colorant (cyan pigment) is dispersed such that colorant dispersion (1) is prepared. In the colorant dispersion (1), a volume average particle diameter of a colorant (cyan pigment) is 0.15 μm and particle concentration of the colorant is 23%.

Preparation of Toner Particles

| | |
|---|---|
| Resin fine particle dispersion (1) | 400 parts |
| Releasing agent dispersion (1) | 50 parts |
| Colorant dispersion (1) | 22 parts |

These substances are added in the round stainless steel flask, and then 1.5 parts of 10% poly aluminum chloride aqueous solution (manufactured by Asada Chemical Co., Ltd.) is put in, and the system in 0.1 N of a nitric acid aqueous solution is regulated to pH 2.5. Then, the obtained content is stirred at room temperature for 30 minutes, is mixed, is dispersed in the homogenizer (manufactured by IKA Works, Inc., Ultra-Turrax T50), is stirred and heated to 45° C. in an oil bath for heating, and is kept for 30 minutes. Subsequently, after 50 parts of resin dispersion is additionally added, the obtained content is heated to 50° C., and is kept for one hour.

When the obtained content is observed using an optical microscope, it is verified that agglomerated particles having a particle diameter of substantially 7.5 μm are generated. In aqueous sodium hydroxide, pH is regulated to be 7.5, then, the content is heated to 80° C. using the oil bath for heating and is kept for two hours as is. The content is cooled to room temperature, is filtered, is sufficiently purified using the ion-exchanged water, is dried using a vacuum drier, and then toner particles 1 are obtained.

Colloidal silica (manufactured by Nippon Aerosil Co., Ltd., R972) is added by 1.7 parts with respect to 100 parts of the respective obtained toner particles, is externally mixed in a Henschel mixer, and toner 1 for developing an electrostatic image, which has a compression ratio of 0.34, is obtained.

Colloidal silica (manufactured by Nippon Aerosil Co., Ltd., R972) is added by 1.5 parts with respect to 100 parts of the respective obtained toner particles, is externally mixed in a Henschel mixer, and toner 2 for developing an electrostatic charge image, which has a compression ratio of 0.35, is obtained.

Colloidal silica (manufactured by Nippon Aerosil Co., Ltd., R972) is added by 1.2 parts with respect to 100 parts of the respective obtained toner particles, is externally mixed in a Henschel mixer, and toner 3 for developing an electrostatic charge image, which has a compression ratio of 0.4, is obtained.

Colloidal silica (manufactured by Nippon Aerosil Co., Ltd., R972) is added by 0.7 parts with respect to 100 parts of the respective obtained toner particles, is externally mixed in a Henschel mixer, and toner 4 for developing an electrostatic charge image, which has a compression ratio of 0.44, is obtained.

Colloidal silica (manufactured by Nippon Aerosil Co., Ltd., R972) is added by 0.5 parts with respect to 100 parts of the respective obtained toner particles, is externally mixed in a Henschel mixer, and toner 5 for developing an electrostatic charge image, which has a compression ratio of 0.45, is obtained.

Colloidal silica (manufactured by Nippon Aerosil Co., Ltd., R972) is added by 0.4 parts with respect to 100 parts of the respective obtained toner particles, is externally mixed in a Henschel mixer, and toner 6 for developing an electrostatic charge image, which has a compression ratio of 0.46, is obtained.

Preparation of Electrostatic Charge Image Developer

A coating agent resin solution obtained by mixing and stirring of 1.25 parts of an ethyl acetate solution of 80% of a trifunctional isocyanate (Takenate D110N, manufactured by Takeda Chemical Industries, Ltd.) in carbon dispersion in which 0.12 parts of carbon black (trade name: VXC-72, manufactured by Cabot Corporation) is mixed to 1.25 parts of toluene and mixing and dispersion is performed for 20 minutes in a sand mill, and Mn—Mg—Sr ferrite particles (average volume particle diameter: 35 μm) are put in a kneader, the content is mixed and stirred for five minutes at normal temperature, and then is heated to 150° C. at normal pressure, and a solvent is distilled. After the content is further mixed and stirred for 30 minutes, the power of the heater is cut off and the content is cooled to 50° C. An obtained coated carrier is sieved using a mesh of 75 μm and the carrier is produced. The carrier is mixed by parts with 5 parts of the toner for developing an electrostatic charge image in a V blender and electrostatic charge image developer is obtained.

The temperature of the reactant in the production of the resin (1) is kept at 200° C., a resin (2) and resin fine particle dispersion (2) are produced in the same method as of producing the resin (1) except that the four-hour reaction is performed for Y hours at X° C., and toner particles (2) are produced in the same ways as the toner particles (1) except that the resin fine particle dispersion is changed to the resin fine particle dispersion (2).

Evaluation of Fluidity of Toner

It is possible to obtain, by the following equation, the compression ratio of the toner using a powder tester (Hosokawa Micron Ltd).

compression ratio=[(hardened particle density)−(loose particle density)]/(hardened particle density)

Hereinafter, a list of toners of Examples is shown.

TABLE 1

| | Compression ratio | Amount of external addition |
|---|---|---|
| Toner 1 | 0.34 | 1.7% |
| Toner 2 | 0.35 | 1.5% |
| Toner 3 | 0.4 | 1.2% |
| Toner 4 | 0.44 | 0.7% |
| Toner 5 | 0.45 | 0.5% |
| Toner 6 | 0.46 | 0.4% |

The toner bottle 110 illustrated in FIG. 3 to FIG. 6 is again described.

An external thread 114 is formed in the vicinity of the opening 111 of the toner bottle on the outer circumferential surface 110*a* of the toner bottle 110. An internal thread 122 (refer to FIG. 6) of the stirring member 120 is screwed on the external thread 114 and the stirring member 120 is fixed to the toner bottle 110. Accordingly, the toner bottle 110 and the stirring member 120 rotate integrally.

The stirring member 120 has a cylindrical section 121 which is opened on the toner bottle 110 side and the internal thread 122 is formed on the inner circumferential surface of the cylindrical section 121. In addition, a stirring blade 123 sticking out to the flange 140 side is provided in the stirring member 120. Here, as illustrated in FIG. 6, a hollow cylindrical portion 141 which is opened toward a facing direction to the toner bottle 110 is also formed in the flange 140. The stirring blade 123 of the stirring member 120 is disposed in the cylindrical portion 141 of the flange 140. The stirring blade 123 stirs the toner reaching inside the flange 140 from the opening 111 of the toner bottle 110 in a circling direction (arrow R direction) around the rotation axis and plays a role of preventing the toner from aggregating. A fitting hole 124 is provided at the tip end of the stirring blade 123. Meanwhile, a through-hole 142 is formed at a position of the flange 140, which faces the fitting hole 124. The coupling 160 is inserted into the through-hole 142 from the outer side (left side in FIG. 6) of the flange 140 and the fitting hole 124 is fitted into the through-hole. When the toner cartridge 100 is mounted in the image forming apparatus 1 (refer to FIG. 1 and FIG. 2), the coupling 160 is fastened with a coupling of the apparatus main body side (not illustrated). Also, the coupling 160 is driven to rotate through the coupling on the apparatus main body side, by a motor (not illustrated) which is provided on the apparatus main body side. The coupling 160 is fitted into the fitting hole 124 of the stirring member 120 and, when the coupling 160 rotates, the stirring member 120 also rotates integrally. In addition, the stirring member 120 is fixed to the toner bottle 110, and thus, when the stirring member 120 rotates, the toner bottle 110 also integrally rotates.

A locking groove 125 continuous in a circumferential direction is provided in the outer circumferential section 120*a* of the stirring member 120. Meanwhile, a locking claw 146 fitted into the locking groove 125 is provided in the flange 140. The locking claw 146 causes the flange 140 to be fixed to the stirring member 120 in the rotation axis direction (right-left direction in FIG. 6) and slides along the locking groove 125 in the rotating direction (arrow R direction illustrated in FIG. 3 and FIG. 4). When the toner cartridge 100 is mounted in the image forming apparatus 1, the flange 140 is fixed to a non-rotating state with respect to the apparatus main body. Accordingly, the stirring member 120 slides on the locking claw 146 of the flange 140 and rotates.

The ring-shaped sealing member 130 is interposed between the stirring member 120 and the flange 140 and is crushed against a round protruding ridge 147 of the flange 140. The sealing member 130 prevents the toner from leaking between the stirring member 120 and the flange 140. In addition, another ring-shaped sealing member 150 is disposed at a position at which the sealing member surrounds the through-hole 142 of the flange 140 and prevents the toner from leaking from the through-hole 142 of the flange 140.

The flange 140 plays a role of a lid to the toner bottle 110 together with the stirring member 120 or the like and further has an outlet 143 through which the toner flows out. The periphery of the outlet 143 is covered with another sealing member 144. Further, the outlet 143 and the sealing member 144 are covered with a shutter 145. The shutter 145 is opened when the toner cartridge 100 is mounted in the image forming apparatus 1 and is shut when the toner cartridge is removed. As above, when the toner cartridge 100 is mounted in the image forming apparatus 1, the shutter 145 is opened and further the flange 140 is maintained in the non-rotating state. Further, the coupling (not illustrated) on the apparatus main body side and the coupling 160 of the toner cartridge 100 are fastened. The coupling 160 is driven to rotate through the coupling on the apparatus main body side, by the motor on the apparatus main body side. Also, the driven rotation enables the stirring member 120 and the toner bottle 110 of the toner cartridge 100 to rotate. The rotation of the toner bottle 110 enables the toner in the toner bottle 110 to be conveyed to the opening 111 side, conveyed out from the opening 111, and enters the flange 140. The toner entering the flange 140 is stirred by the stirring blade 123 of the stirring member 120 and flows out to the outside of the toner cartridge 100 from the outlet 143.

The toner cartridge 100 described here is representative of toner cartridges 100Y, 100M, 100C, and 100K illustrated in FIG. 2. In other words, the toner flowing out from the toner cartridge 100 is supplied to the corresponding developing device 54 and is used to form a toner image.

Here, the toner cartridge 100 of the exemplary embodiment is driven to rotate through the coupling 160 provided on the rotation axis. Accordingly, a configuration of a driving system which drives the toner cartridge to rotate is simplified, compared to a configuration in which a gear is formed in the toner bottle 110 and the gear is driven. In addition, no space between the four toner cartridges 100Y, 100M, 100C, and 100K illustrated in FIG. 2 is needed to dispose a gear (refer to FIG. 3) or the like such that space saving is achieved.

In addition, in the case of the toner cartridge 100 of the present exemplary embodiment, although the toner bottle 110 is tapered by 5 degrees toward the opening 111, an opening, which is significantly tapered toward the rotation axis direction as illustrated in the related art, does not exist, and thus a structure of scooping the toner (a scooping shape, member, or the like) toward the opening is not needed. Hence, a simple structure is achieved and further the toner cartridge 100 is suitable for containing and conveying out of the toner having low fluidity.

Figure 7:
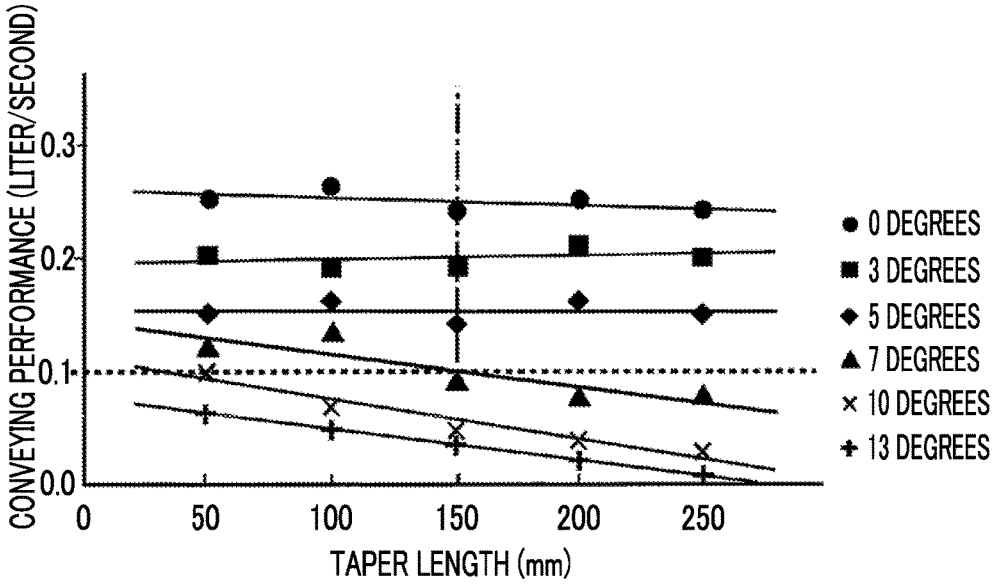
FIG. 7 is a graph illustrating an example of conveying performance of a protruding ridge when an inclination angle and a taper length are changed.

FIG. 7 is a graph illustrating an example of conveying performance of a protruding ridge when an inclination angle and a taper length are changed.

Here, similar to the toner bottle 110 illustrated in FIG. 3 to FIG. 5, the toner bottle has a protruding ridge and has a shape with a small diameter reduced toward the opening, plural toner bottles, in which the angle reduction or length is variously changed, are produced, and conveying performance of the toner by the protruding ridge is measured. Here, toner (toner 3 shown in Table 1 described above) having the compression ratio of 0.4 is used.

FIG. 7 shows a measurement result thereof. In FIG. 7, the horizontal axis represents a taper length (inclination) and the vertical axis represents the conveying performance (liter/second).

The conveying performance is obtained to be equal to or more than 0.1 liter/second. In this respect, it is preferable that the inclination angle is equal to or less than 5 degrees. It is preferable that the taper length is equal to or less than 150 mm when the tapering (inclination) is employed in the tapered section B of the toner bottle 110 illustrated in FIG. 3 to FIG. 6 and when a size of accommodation of the toner cartridge 100 in the image forming apparatus 1 is considered. In addition, it is preferable that the size of the opening of the toner bottle 110 is equal to or more than 75% of the main body A. In this respect, it is desirable that the taper length is equal to or less than 150 mm.

Next, the protruding ridge formed in the toner bottle will be brought under review.

Figure 8:
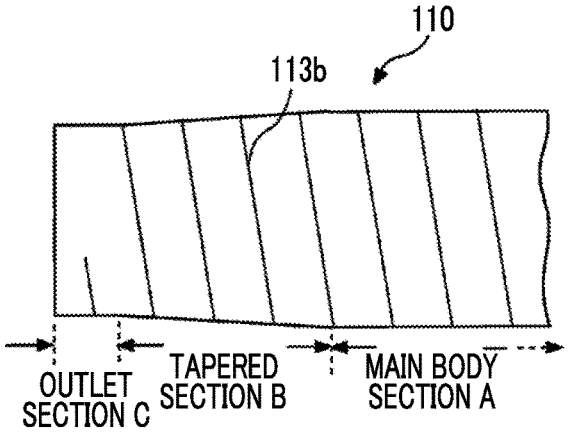
FIG. 8 is a view schematically illustrating a toner bottle and its protruding ridge illustrated in FIG. 3 to FIG. 6.

FIG. 8 is a view schematically illustrating the toner bottle and its protruding ridge illustrated in FIG. 3 to FIG. 6.

In FIG. 8, a shape in the vicinity of the opening of the toner bottle 110 and the protruding ridge 113*b* on the inner wall surface are illustrated.

As described above, the toner bottle 110 has the main body section A having substantially the same diameter, the tapered section B having a diameter which is gradually reduced toward the opening immediately before reaching the opening, and outlet section C having substantially the same diameter, which is formed between the opening and the end of the tapered section B on the opening side.

Here, the protruding ridge 113*b* is formed on the toner bottle 110 from the main body section A through the tapered section B to reaching the outlet section C. Here, no protruding ridge is formed in a portion of the edge of the outlet section C on the opening side. This is because there is a need to form a structure of attaching a component (in the case of the toner cartridge 100 illustrated in FIG. 3 to FIG. 6, the stirring member 120 configuring the lid member) which configures a lid section of the toner cartridge 100, such as the external thread 114 illustrated in FIG. 3 or the like.

As illustrated in FIG. 8, the toner bottle 110 is disposed in a posture of horizontal orientation. Accordingly, when a contained amount of the toner in the toner bottle 110 is decreased, the toner gathers on the lower portion of the toner bottle in the position of the horizontal orientation. When the toner bottle 110 rotates, the toner inside the toner bottle is pushed to the protruding ridge 113*b* protruding from the inner wall surface and is conveyed toward the opening; however, the lower surface of the tapered section B forms an ascending surface toward the opening. Therefore, in the toner in the tapered section B, orientation of falling through the ascending surface, that is, a force is applied in a direction opposite to a conveying direction by the protruding ridge 113*b*. Here, since the protruding ridge 113*b* is formed over the entire length of the toner bottle 110 in the longitudinal direction, the toner in the tapered section B is conveyed toward the outlet section C by the protruding ridge 113*b* in the tapered section B against the force of falling.

The toner conveyed to the outlet section C is further conveyed to the outlet section C by the protruding ridge 113*b*; however, no conveying force is directly applied, by the protruding ridge 113*b*, to the toner conveyed to the edge on the opening side at which the protruding ridge 113*b* is cut off. Here, the toner conveyed to the edge on the opening is pushed toward the opening and is discharged from the opening by the conveyed toner, which is positioned in a position separated from the opening.

In the last stage in which the toner bottle 110 is empty, no other conveying force is applied to the toner positioned at the edge of the outlet section C on the opening side and the toner remains in the toner bottle 110.

Here, on the side illustrated in FIG. 8, since the protruding ridge 113*b* is formed to an intermediate portion of the outlet section C, little amount of toner remains when the toner bottle 110 is empty.

Figure 9:
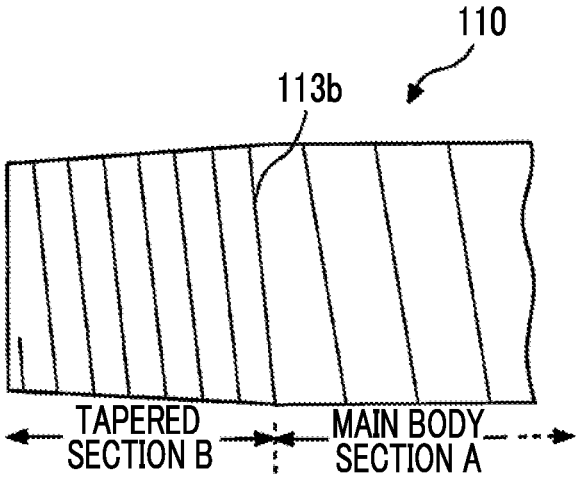
FIG. 9 is a view schematically illustrating another example of a toner bottle and its protruding ridge.

FIG. 9 is a view schematically illustrating another example of the toner bottle and its protruding ridge. Here, for convenience, the same reference signs as in FIG. 8 are assigned to the same components in FIG. 9.

The main body section A and the tapered section B are provided in the toner bottle 110; however, a portion corresponding to the outlet section C does not exist in the toner bottle 110 illustrated in FIG. 8. In other words, the tapered section B is continuous to the second end at which the opening is formed. The protruding ridge 113*b* extends in the spiral shape from the main body section A to reaching the tapered section B. Here, the protruding ridge 113*b* is cut off in the portion at the edge of the tapered section B on the opening side. As above, this is because there is a need to provide an attachment structure of the lid member configuring the toner cartridge, in the portion at the edge on the opening side.

Since a portion of the lid member, which is attached to the toner bottle 110, normally has a uniform diameter, the portion of the toner bottle 110, to which the lid member is attached, has a uniform diameter.

Here, the protruding ridge 113*b* in the example illustrated in FIG. 9 has a spiral shape in the tapered section B at intervals narrower than those in the main body section A.

As above, the toner in the toner bottle 110 is conveyed in the tapered section B toward an ascending surface by being pushed to the protruding ridge 113*b*. Therefore, the toner conveyed to the portion of the tapered section B at the edge on the opening side, at which the protruding ridge 113*b* is cut off, not only loses the direct conveying force, but also a falling force through the surface, which is inclined as being separated from the opening, is applied to the toner. When a sufficient amount of the toner remains, the toner of the portion is pushed by toner which is conveyed from the rear and is discharged. Here, at the last stage in which the toner bottle 110 is empty, only a falling force through the surface which is inclined as being separated from the opening is applied to the toner positioned at a position at the edge of the tapered section B on the opening side.

Here, in the example illustrated in FIG. 9, the spirals of the protruding ridges in the tapered section B are formed at intervals narrower than those in the intervals of the spirals in the main body section A. The shorter a distance of falling of the toner on the inclined surface is, the narrower intervals the protruding ridges 113*b* in the tapered section B are disposed at. In the example illustrated in FIG. 9, since the intervals of the spirals of the protruding ridges 113*b* in the tapered section B are narrower than those in the main body section A, it is possible to suppress an amount of the remaining toner to little amount at the last stage at which it is determined that the toner bottle 110 is empty, compared to a case where the spirals of the protruding ridges 113*b* are disposed at equal intervals to those in the main body section A.

Figure 10:
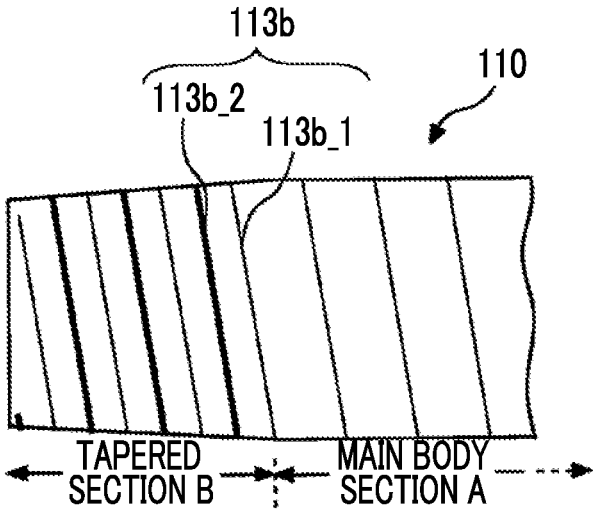
FIG. 10 is a view schematically illustrating still another example of a toner bottle and its protruding ridge.

FIG. 10 is a view schematically still another example of a toner bottle and its protruding ridge.

Here, for convenience, the same reference signs as in FIG. 8 and FIG. 9 are assigned to the same components in FIG. 10.

The entire shape of the toner bottle 110 illustrated in FIG. 10 is the same as the toner bottle 110 illustrated in FIG. 9 except for the shape of the protruding ridge 113*b*. In other words, the toner bottle 110 illustrated in FIG. 10 has the main body section A and the tapered section B. The portion corresponding to the outlet section C in the toner bottle 110 illustrated in FIG. 8 does not exist.

Here, as described above, the portion, to which the lid member is attached, needs to have the uniform diameter and an attachment portion (not illustrated), to which the lid member is attached and which has the uniform diameter at the tip of the tapered section B, exists.

In other words, the second end in the exemplary embodiment of the invention means an end of a portion except for the attachment portion.

The protruding ridge 113*b* of the toner bottle 110 illustrated in FIG. 10 is configured to have a protruding ridge 113*b*_1 having a first spiral shape extending form the main body section A to the tapered section B, and a protruding ridge 113*b*_2 having a second spiral shape formed in the tapered section B. Here, neither the protruding ridges 113*b*_1 nor 113*b*_2 are formed in the portion at the edge on the opening side but are cut off slightly before the opening (second end). The protruding ridge 113*b*_1 is formed to have the spiral shape at the equal intervals from the main body section A to the tapered section B. In addition, the protruding ridge 113*b*_2 has the equal intervals to those of the protruding ridge 113*b*_1, but is only formed in the tapered section B, and extends to have the spiral shape through between the protruding ridges 113*b*_1.

In other words, the protruding ridge 113*b* of the toner bottle 110 illustrated in FIG. 10 has the one-fold spiral shape in the main body section A and two-fold spiral shape in the tapered section B. The protruding ridges 113*b* are disposed at intervals half of the intervals in the main body section A and it is possible to suppress an amount of the remaining toner to little amount at the last stage at which it is determined that the toner bottle 110 is empty, in the same way as in the case of the toner bottle 110 in FIG. 9.

In the schematic views in FIG. 8 to FIG. 10, the protruding ridges 113*b* (two protruding ridges 113*b*_1 and 113*b*_2 in the example illustrated in FIG. 10) are shown to be continuous, respectively. Here, as illustrated in FIG. 3 to FIG. 6, the protruding ridges 113*b* (protruding ridges 113*b*_1 and 113*b*_2) may be the ridges which are cut off by the rib 118*a* or the like. Further, the protruding ridge may be formed of plural short protruding ridges disposed to be scattered.

In addition, here, as illustrated in FIG. 2, an example, in which an exemplary embodiment of the invention is applied to a so-called tandem color image forming type image forming apparatus, is illustrated; however, an exemplary embodiment of the invention may be widely applied to a type of image forming apparatus, which forms an image using powder sprayed out from a container in which the powder such as toner is contained, such as a monochrome machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder containing device comprising:

a powder container that contains powder, has a first end which is closed, has a second end which is opened, includes a main body section, includes a tapered section which is disposed on the second end side from the main body section and has a diameter that reduces toward the second end, and has an inner circumferential surface on which a protruding ridge is formed to convey the powder to the second end side by rotating around a rotation axis extending in a direction in which the first end and the second end are connected; and a lid member that is provided with an outlet of the powder, is maintained in a non-rotating state, and causes the powder flowing from the opening to flow out from the outlet, wherein the protruding ridge is formed in the main body section and the tapered section, the protruding ridge is formed at narrower intervals in the tapered section than in the main body section, and an angle between the rotation axis and the protruding ridge in the tapered section is closer to a right angle than an angle between the rotation axis and the protruding ridge in the main body section.

2. The powder containing device according to claim 1, wherein the protruding ridge extends to form a spiral shape which is continuous from the main body section to the tapered section.

3. The powder containing device according to claim 2, wherein the tapered section has a diameter reduced at an inclination angle equal to or less than 5 degrees with respect to the rotation axis.

4. An image forming apparatus comprising:

the powder containing device according to claim 3, wherein the image forming apparatus is configured to take powder out of the powder containing device and form an image using the powder.

5. An image forming apparatus comprising:

the powder containing device according to claim 2, wherein the image forming apparatus is configured to take powder out from the powder containing device and form an image using the powder.

6. The powder containing device according to claim 1, wherein the protruding ridge has a first spiral which extends and is discontinuous from the main body section to the tapered section, and a second spiral which extends in the tapered section between the first spirals and is discontinuous, so that double spirals are formed in the tapered section.

7. The powder containing device according to claim 6, wherein the tapered section has a diameter reduced at an inclination angle equal to or less than 5 degrees with respect to the rotation axis.

8. An image forming apparatus comprising:

the powder containing device according to claim 7, wherein the image forming apparatus is configured to take powder out of the powder containing device and form an image using the powder.

9. An image forming apparatus comprising:

the powder containing device according to claim 6, wherein the image forming apparatus is configured to take powder out of the powder containing device and form an image using the powder.

10. An image forming apparatus comprising:

the powder containing device according to claim 1, wherein the image forming apparatus is configured to take powder out from the powder containing device and form an image using the powder.

11. A powder containing device comprising:

a powder container that contains powder, has a first end which is closed, has a second end which is opened, includes a main body section, includes a tapered section which is disposed to be closer to the second end than the main body section and has a diameter that reduces toward the second end, an outlet section which is disposed on the second end side from the tapered section and extends to the opening and has a diameter which is the same as a diameter of the tapered section or has a diameter that is gently inclined from the tapered section, and an inner circumferential surface on which a protruding ridge is disposed laterally and is configured to convey the powder to the second end side by rotating around a rotation axis extending in a direction in which the first end and the second end are connected; and a lid member that is provided with an outlet of the powder, is maintained in a non-rotating state, and causes the powder flowing from the opening to flow out from the outlet, wherein the protruding ridge extends from the main body section to the outlet section and passes through the tapered section, and an angle between the rotation axis and the protruding ridge in the tapered section is closer to a right angle than an angle between the rotation axis and the protruding ridge in the main body section.

12. The powder containing device according to claim 11, wherein the tapered section has a diameter reduced at an inclination angle equal to or less than 5 degrees with respect to the rotation axis.

13. An image forming apparatus comprising:

the powder containing device according to claim 12, wherein the image forming apparatus is configured to take powder out of the powder containing device and form an image using the powder.

14. An image forming apparatus comprising:

the powder containing device according to claim 11, wherein the image forming apparatus is configured to take powder out of the powder containing device and form an image using the powder.

15. A powder containing device comprising:

a powder container that contains powder, has a first end which is closed, has a second end which is opened, includes a main body section, includes a tapered section which is disposed on the second end side from the main body section and has a diameter that reduces toward the second end, and has an inner circumferential surface on which a protruding ridge is formed to convey the powder to the second end side by rotating around a rotation axis extending in a direction in which the first end and the second end are connected; and a lid member that is provided with an outlet of the powder, is maintained in a non-rotating state, and causes the powder flowing from the opening to flow out from the outlet, wherein the protruding ridge is formed in the main body section and the tapered section, the protruding ridge is formed at narrower intervals in the tapered section than in the main body section, and the tapered section has a diameter reduced at an inclination angle equal to or less than 5 degrees with respect to the rotation axis.

16. An image forming apparatus comprising:

the powder containing device according to claim 15, wherein the image forming apparatus is configured to take powder out of the powder containing device and form an image using the powder.

* * * * *